US010661133B2

(12) United States Patent
Cemel

(10) Patent No.: US 10,661,133 B2
(45) Date of Patent: May 26, 2020

(54) METHOD AND SYSTEM FOR A CUSTOMIZABLE WEIGHTED GOLF CLUB SHAFT

(71) Applicant: Adrian Cemel, Eager, AZ (US)

(72) Inventor: Adrian Cemel, Eager, AZ (US)

( * ) Notice: Subject to any disclaimer, the term of this patent is extended or adjusted under 35 U.S.C. 154(b) by 0 days.

(21) Appl. No.: 16/057,630

(22) Filed: Aug. 7, 2018

(65) Prior Publication Data

US 2019/0046849 A1 Feb. 14, 2019

Related U.S. Application Data

(60) Provisional application No. 62/542,577, filed on Aug. 8, 2017.

(51) Int. Cl.

| | |
|---|---|
| ***A63B 53/06*** | (2015.01) |
| ***A63B 53/08*** | (2015.01) |
| ***A63B 1/00*** | (2006.01) |
| *A63B 102/32* | (2015.01) |
| *A63B 53/04* | (2015.01) |
| *A63B 53/12* | (2015.01) |
| *A63B 53/10* | (2015.01) |

(52) U.S. Cl.

CPC ..... *A63B 53/08* (2013.01); *A63B 1/00* (2013.01); *A63B 53/047* (2013.01); *A63B 53/0466* (2013.01); *A63B 53/10* (2013.01); *A63B 53/12* (2013.01); *A63B 2102/32* (2015.10)

(58) Field of Classification Search

CPC ..... A63B 53/10; A63B 53/14; A63B 53/12; A63B 53/16; A63B 53/08; A63B 53/047; A63B 53/0466; A63B 2102/32

See application file for complete search history.

(56) References Cited

U.S. PATENT DOCUMENTS

| | | | | |
|---|---|---|---|---|
| 1,133,129 A * | 3/1915 | Govan | ..... | A63B 53/0466 473/337 |
| 2,023,131 A | 12/1935 | Gibson | | |
| 2,135,648 A | 11/1938 | Stumpf | | |
| 2,462,955 A | 3/1949 | Glancey | | |
| 2,608,409 A | 8/1952 | Pinkerton | | |
| 2,950,115 A | 8/1960 | Hurdzan | | |
| 3,341,203 A | 9/1967 | Brill | | |
| 3,351,346 A | 11/1967 | Strahan | | |

(Continued)

OTHER PUBLICATIONS

Kelley Brent "Understanding Swingweight," https://www.thoughtco.com/understanding-swingweight-1560536, pp. 1-3, printed on Dec. 17, 2018.

(Continued)

*Primary Examiner* — Stephen L Blau

(74) *Attorney, Agent, or Firm* — Snell & Wilmer L.L.P.

(57) ABSTRACT

In an example embodiment, a golf club shaft is disclosed that comprises: a grip portion and a central shaft. The central shaft comprises a plurality of holes capable of being removably filled by one or more weighted plugs. In various example embodiments, the weighted plugs may be any weight desirable to the golfer, and may be positioned at any location on the shaft where there is a hole to customize the weighting of the golf club. In such embodiments, the weighted plugs may be made of a high density material and may weigh above about 14 grams.

10 Claims, 4 Drawing Sheets

(56) References Cited

U.S. PATENT DOCUMENTS

| | | | | | |
|---|---|---|---|---|---|
| 3,556,533 | A * | 1/1971 | Hollis | A63B 53/04 473/338 |
| 3,608,907 | A | 9/1971 | Bouchard | |
| 3,680,870 | A | 8/1972 | Burnett | |
| 3,716,239 | A | 2/1973 | Goudreau | |
| 4,037,668 | A | 7/1977 | Svejda | |
| 4,045,034 | A | 8/1977 | Thomas | |
| 4,380,337 | A * | 4/1983 | DiMatteo | A63B 57/353 473/285 |
| 4,444,396 | A | 4/1984 | Wendt | |
| 4,588,191 | A | 5/1986 | Stewart | |
| 4,602,788 | A | 7/1986 | Wendt | |
| 4,809,975 | A | 3/1989 | Lee | |
| 4,852,782 | A | 8/1989 | Wu | |
| 4,869,507 | A * | 9/1989 | Sahm | A63B 53/04 473/337 |
| 5,165,744 | A | 11/1992 | Vogrin | |
| 5,178,394 | A | 1/1993 | Tanampai | |
| 5,253,867 | A | 10/1993 | Gafner | |
| 5,460,378 | A | 10/1995 | Getts | |
| 5,494,279 | A | 2/1996 | Ahner | |
| 5,527,039 | A | 6/1996 | Levesque | |
| 5,573,468 | A | 11/1996 | Baumann | |
| 5,711,718 | A | 1/1998 | Mueller | |
| 5,769,734 | A | 6/1998 | Qualey | |
| 5,776,006 | A | 7/1998 | Gruber | |
| 5,807,183 | A | 9/1998 | Benson | |
| 5,897,440 | A * | 4/1999 | Bae | A63B 60/00 473/201 |
| 5,993,325 | A | 11/1999 | Heyer | |
| 6,083,116 | A | 7/2000 | Loredo | |
| 6,120,385 | A | 9/2000 | Nemeckay | |
| 6,159,107 | A * | 12/2000 | Walton | A63B 53/00 473/282 |
| 6,186,904 | B1 | 2/2001 | Bass | |
| 6,203,447 | B1 | 3/2001 | Dillard | |
| 6,231,453 | B1 | 5/2001 | Jebe | |
| 6,257,992 | B1 * | 7/2001 | LeBlanc | A63B 53/10 473/316 |
| 6,257,997 | B1 | 7/2001 | Doble | |
| 6,343,999 | B1 | 2/2002 | Murtland | |
| 6,358,157 | B1 | 3/2002 | Sorenson | |
| 6,413,168 | B1 | 7/2002 | McKendry | |
| 6,475,098 | B1 | 11/2002 | Nemeckay | |
| 6,547,673 | B2 | 4/2003 | Roark | |
| 6,599,201 | B1 | 7/2003 | Grant | |
| 6,612,936 | B1 | 9/2003 | Matias | |
| 6,939,273 | B2 | 9/2005 | Zajac | |
| 6,955,610 | B1 | 10/2005 | Czaaja | |
| 7,048,640 | B2 | 5/2006 | Light | |
| 7,115,042 | B2 | 10/2006 | Gulan | |
| 7,316,622 | B1 | 1/2008 | Lucas | |
| 7,686,705 | B1 | 3/2010 | Foley | |
| 8,192,298 | B2 * | 6/2012 | Droppleman | A63B 53/00 473/296 |
| 2002/0091012 | A1 | 7/2002 | Evans | |
| 2002/0128085 | A1 | 9/2002 | Kallasy | |
| 2003/0224867 | A1 | 12/2003 | Ota | |
| 2004/0009826 | A1 | 1/2004 | Aisenberg | |
| 2004/0018885 | A1 | 1/2004 | Gulan | |
| 2004/0023726 | A1 | 2/2004 | Ritson | |
| 2004/0147333 | A1 | 7/2004 | Clark | |
| 2004/0259666 | A1 | 12/2004 | Bjugstad | |
| 2005/0009620 | A1 | 1/2005 | Hodgetts | |
| 2005/0245324 | A1 | 11/2005 | Light | |
| 2006/0270487 | A1 | 11/2006 | Tu Teng | |
| 2007/0066418 | A1 | 3/2007 | Adams | |
| 2014/0228144 | A1 * | 8/2014 | Moreira | A63B 53/14 473/300 |
| 2017/0291292 | A1 * | 10/2017 | Busato | B25G 1/06 |

OTHER PUBLICATIONS

Pedersen, Mike "Do You Understand Golf Club Swing Weight," http://ezinearticles.com/?Do-You-Understand-Golf-Club-Swing-Weight&id=46079, pp. 1-2, printed on Dec. 17, 2018.

* cited by examiner

200

METHOD AND SYSTEM FOR A CUSTOMIZABLE WEIGHTED GOLF CLUB SHAFT

CROSS-REFERENCE TO RELATED APPLICATIONS

This application is a non-provisional patent application of, and claims priority to, U.S. Provisional Pat. App. No. 62/542,577 filed Aug. 8, 2017 and entitled "METHOD AND SYSTEM FOR A CUSTOMIZABLE WEIGHTED GOLF CLUB SHAFT," which is incorporated herein by reference in its entirety.

FIELD OF INVENTION

The present invention is in the area of golfing apparatus and more specifically a system for improving club function.

BACKGROUND OF THE INVENTION

Much effort has gone into design of the club head since this is the part of the club that strikes the ball and controls the transfer of energy as well as the aiming of the ball. Each of the fourteen clubs in the bag are differently configured for different purposes (e.g., driver, fairway wood, wedges, hybrid, irons, and putter). In recent past, the sport has seen an increase in specialized, redesigned club heads with internal, external, interchangeable, heel and/or toe weighted, perimeter weighted, and even sliding weights engineered to enhance aim, distance, feel, forgiveness, flight, launch, among others.

However, apart from efforts to make the club shaft lighter and stronger, not as much effort has gone into shaft design. There has long been a recognition that club function can be altered according to the distribution of weight along the shaft. A number of prior art devices have included ring shaped weights surrounding and attached to the golf club shaft in an effort to alter the weight distribution of the club. However, such attached weights are not completely in line with the shaft and the protruding weights may have undesired aerodynamic effects. In addition, while there has been an understanding that altering the weight distribution alters the way the club behaves, there has generally not been a method for effectively employing such alterations in weight distribution.

Even prior art systems that do discuss weighting a shaft, do so by placing rectangular 1 oz. weights along multiple slots throughout the shaft, or use other external attachments such as rings in an effort to alter weight distribution. However, these systems alter the aerodynamic properties of the golf clubs and may harm the equal bending and twisting properties of the shaft in a negative way.

SUMMARY OF THE INVENTION

In an example embodiment, a golf club shaft is disclosed that comprises: a grip portion and a central shaft. The central shaft comprises a plurality of holes capable of being removably filled by one or more weighted plugs. In various example embodiments, the weighted plugs may be any weight desirable to the golfer, and may be positioned at any location on the shaft where there is a hole to customize the weighting of the golf club. In such embodiments, the weighted plugs may be made of a high density material and may weigh above about 14 grams.

In accordance with an example embodiment, a user may use as many or as few weighted plugs as desired. In such an embodiment, the user may decide to leave any unused holes open, or may choose to fill such holes with unweighted plugs to aid in maintaining the aerodynamics of a golf club.

A method for using such a golf club is also disclosed.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

The detailed description shows embodiments by way of illustration, including the best mode. While these embodiments are described in sufficient detail to enable those skilled in the art to practice the principles of the present disclosure, it should be understood that other embodiments may be realized and that logical and mechanical changes may be made without departing from the spirit and scope of principles of the present disclosure. Thus, the detailed description herein is presented or purposes of illustration only and not of limitation. For example, the steps recited in any of the method descriptions may be executed in any order and are not limited to the order presented.

Moreover, for the sake of brevity, certain sub-components of individual components and other aspects of the system may not be described in detail herein. It should be noted that many alternative or additional functional relationships or physical couplings may be present in a practical system. Such functional blocks may be realized by any number of components configured to perform specified functions.

The present invention includes a system for modifying weight distribution on a golf shaft so as to improve the overall accuracy of a stroke via use of a customizable in-line weight management system. Each golf shaft comprises a grip portion and a central shaft, with the central shaft having a series of holes that can be filled by a plurality of weighted plugs.

Figure 1:
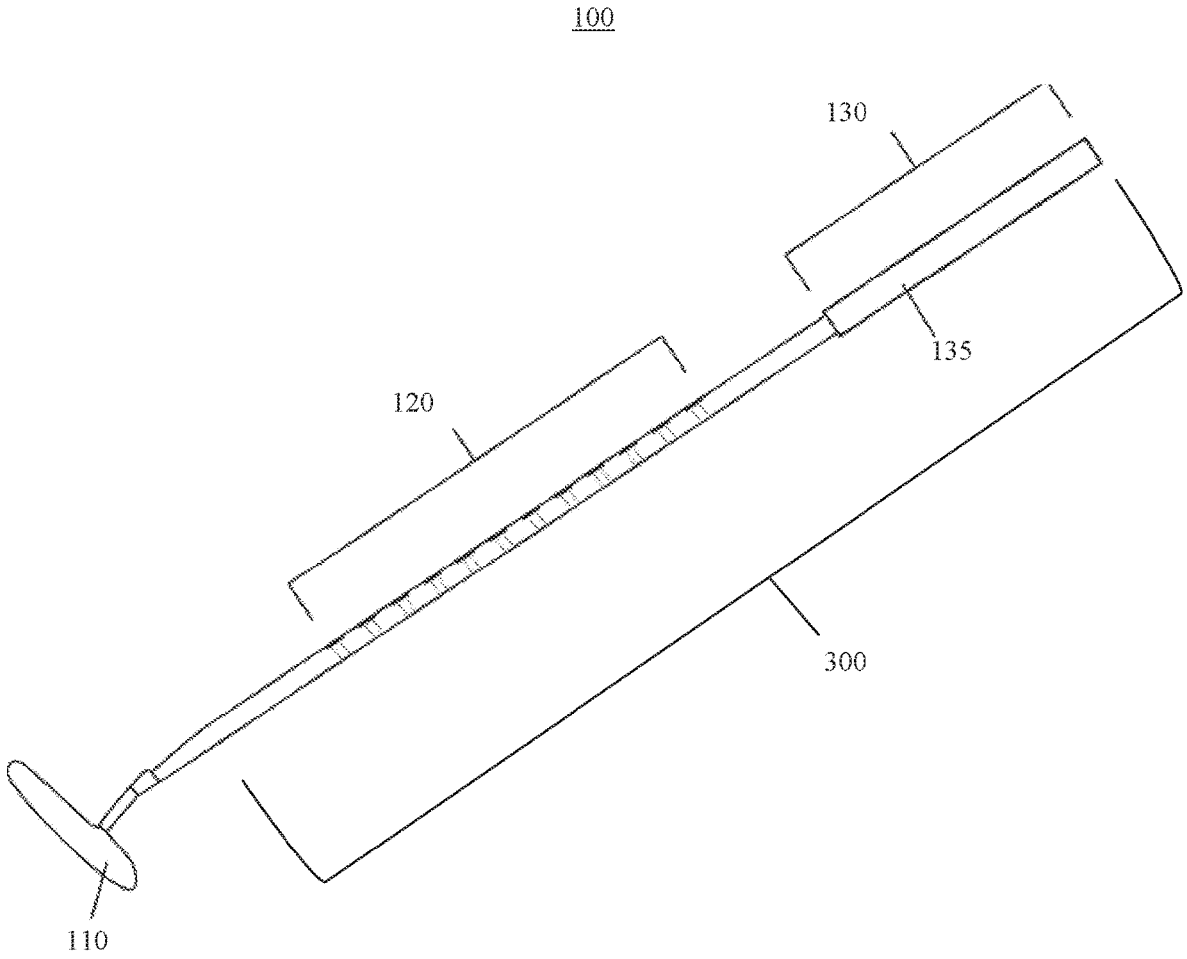
FIG. 1 illustrates a side view of a golf club, in accordance with various example embodiments.

With reference to FIG. 1, a golf club 100 comprises a head 110 and a shaft 300. The shaft comprises a grip portion 130 and a central shaft 120. In various example embodiments, the grip portion 130 may further comprise a grip 135 that may be rubberized or otherwise may conform to a user's hand to allow for proper gripping of the golf club 100. Although any suitable type of golf club may comprise such a design, in one example embodiment, the golf club 100 is a driver. In another example embodiment, the golf club 100 is a putter. In another example embodiment, the golf club 100 is a wedge. In another example embodiment, the golf club 100 is a hybrid. In another example embodiment, the golf club 100 is an iron. In another example embodiment, the golf club 100 is a fairway wood.

The shaft 300 may be made of any type of material suitable to withstand the speed and force of impact for hitting a golf ball. Thus, in an example embodiment, the shaft 300 of a golf club may comprise wood. In an example embodiment, the shaft 300 may comprise steel. In an example embodiment, the shaft 300 may comprise graphite. In an example embodiment, the shaft 300 may comprise carbon fiber. In an example embodiment, the shaft 300 may comprise aluminum. The shaft 300 can be hollow in an example embodiment. In another example embodiment, the shaft 300 can be solid.

Figure 2:
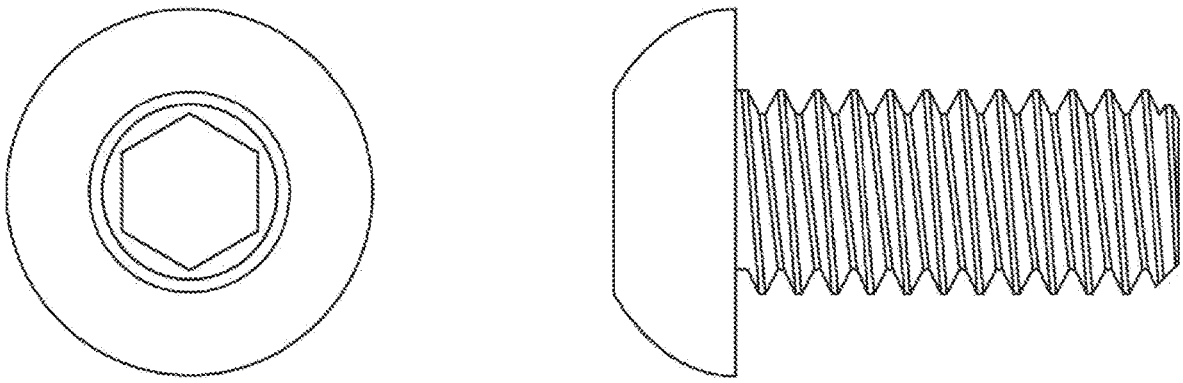
FIG. 2 illustrates a top and side view of a plug, in accordance with various example embodiments.
Figure 3:
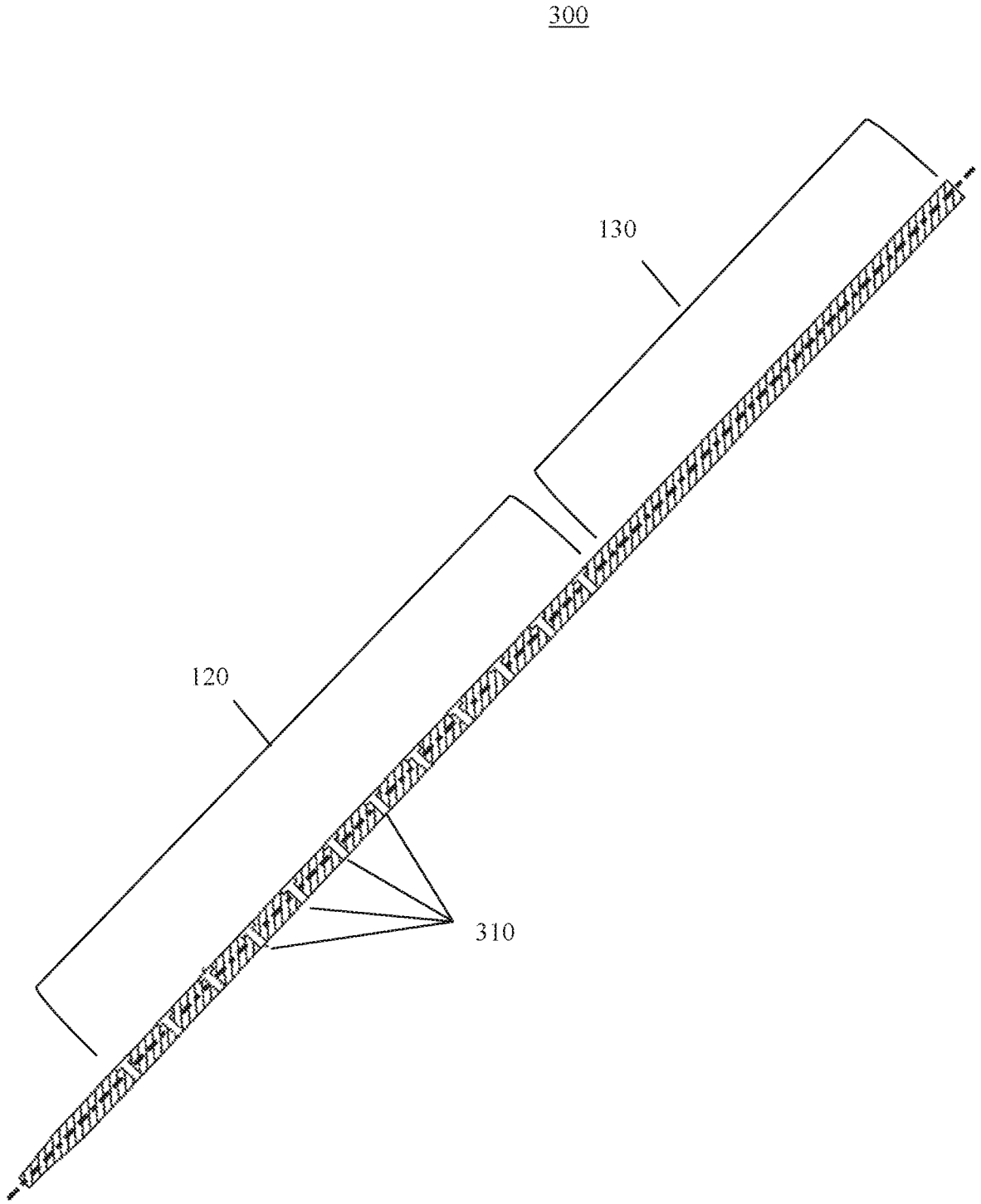
FIG. 3 illustrates a cross-section of a shaft of a golf club, in accordance with various example embodiments.
Figure 4:
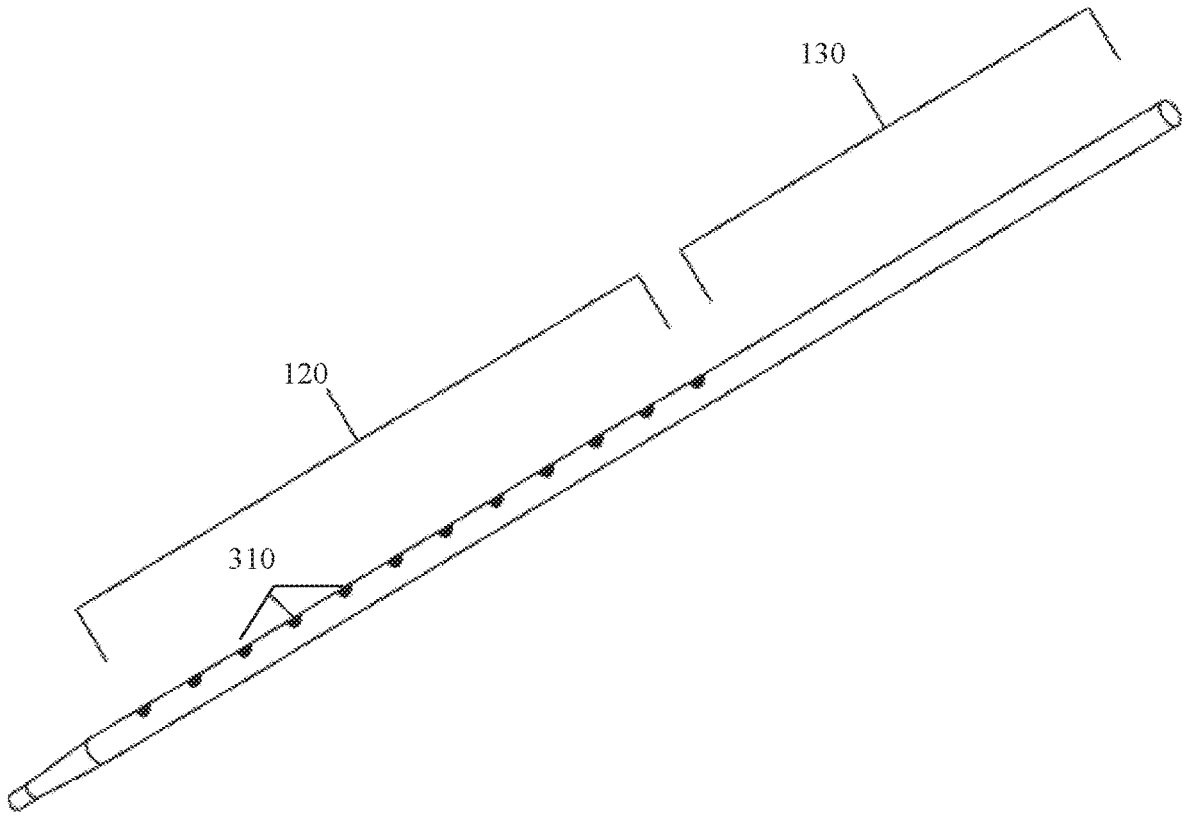
FIG. 4 illustrates a side view of a shaft of a golf club, in accordance with various example embodiments.

Turning now to FIGS. 2 and 3, the central shaft 120 further comprises a series of holes 310 into which a plurality of plugs (an example of which is depicted as 200) can be removably inserted. The holes 310 can be present on ⅚ the length of the shaft 300 in an example embodiment. In another example embodiment, the holes 310 are present on ⅔ the length of the shaft 300. The holes 310 may run ½ the length of the shaft 300, in accordance with an example embodiment. In an example embodiment, the holes 310 may be present on ¼ of the length of the shaft 300. Moreover, the holes may be set at any suitable locations along any suitable portion of the shaft.

The holes 310 may exist at any orientation around the shaft 300. In an example embodiment, the holes 310 may be on a first plane of the golf club shaft. In an example embodiment, some of the holes 310 may be located on a second plane offset from the holes on the first plane by any number of degrees. In an example embodiment, there may be multiple rows of holes 310 on the shaft 300. The present disclosure overcomes the drawbacks of the prior art through independent, individual orientation in either paired or in a sequence of threes on an X and Y plane. In an example embodiment, there may be a set of paired holes. In such an embodiment, a first hole is located on a first plane of the golf club shaft and the second, paired hole may be located on a second plane of the golf club shaft at any angle between 0 degrees and 180 degrees relative to the first plane. In an example embodiment, the paired holes may be counterbalancing. In an example embodiment, the paired holes may be opposing. In another example embodiment, there may be a set of three holes, where a first hole is located on a first plane of the golf club shaft and the second and third holes may be located on a second and third plane wherein each of the second and third planes are offset by any angle between 0 degrees and 180 degrees relative to the first plane. In such an example embodiment, the holes may be counterbalancing. In an example embodiment, the holes may be opposing. In an example embodiment, a first hole is aligned with the X plane, a second hole is aligned with a Y plane at right angle to the X plane, and additional holes along the length of the shaft are aligned with either the X plane or Y plane in a sequence selected to reduce overall variation in shaft deflection in different planes. It should be appreciated that there may be any number of holes, any number of pairings, in any angle or combinations desired. Some of the angles or combinations referenced above may be more optimal than others. Mathematical and instrumental testing theoretically indicates the individual screws are 0.1% VS. 0.3% for paired orientation when measuring the differences in deflection load between the X and Y axis. When the "attenuator," the steel extension, is added to the shaft end, the more flexible, round steel section hides directional differences by a factor of more than 3. This would make the directional differences for both paired and individual screws below 0.1%.

In an example embodiment, the plugs comprise screws. In an example embodiment, the plugs comprise nails. In an example embodiment, the plugs comprise pins. In an example embodiment, the plugs comprise bolts. In an example embodiment, the plugs may be snap-in. In an example embodiment, the plugs may be friction fit. It should be appreciated that the plugs can be any suitable device capable of removably inserting into the holes 310. In an example embodiment, the plugs may protrude no more than five millimeters from the shaft. In an example embodiment, the plugs protrude no more than 3 millimeters from the shaft. In another example embodiment, the end of the plugs is flush with the shaft. In another example embodiment, the plugs are countersunk in the shaft.

At least one of the plugs must comprise a heavy material. In various example embodiments, the plugs are made of metal. In various example embodiments, the metal may be a high density metal. In various example embodiments the metal may be tungsten. In various example embodiments, the metal may be titanium. In various example embodiments, the metal may be stainless steel. In various example embodiments, the metal may be lead. In various example embodiments, the metal may be iron. In various example embodiments, the metal may be cobalt. The weight of the each plug may also be customizable. In various example embodiments, the weight of each plug may be above about 14 grams. In various example embodiments, the weight of each plug may be between about 14 grams to about 120 grams. In various example embodiments, the weight of each plug may be between about 14 grams to about 90 grams. The plugs may individually weigh any number of grams desired by the user. Accordingly, it should be appreciated that the plugs may further comprise any suitable material to achieve such weight restrictions.

Any number of weighted plugs may be used to customizably weight the shaft 300 of the golf club 100. In an example embodiment, a user may use only one weighted plug. In an example embodiment, a user may use multiple weighted plugs. In an example embodiment, a user may leave any unused holes 310 open. In an example embodiment, a user may fill the remainder of the holes 310 with non-weighted plugs. In such an embodiment, the non-weighted plugs may weigh 75% of the weight of a weighted plug. In another such embodiment, the non-weighted plugs may weigh between 50% and 75% of the weight of a weighted plug. In another such embodiment, the non-weighted plugs may weigh between 25% and 50% of the weight of a weighted plug. In another such embodiment, the non-weighted plugs may weigh less than 25% of the weight of a weighted plug. It should be appreciated that a user may decide to use as many or as few weighted plugs as he desires, and may choose to leave any number of holes unfilled, or filled with non-weighted plugs as desired. Each hole may be of any suitable nominal diameter. In an example embodiment, the hole is of a diameter that is 0.5 times the diameter of the shaft or smaller. For example, the diameter may be 0.3 inches or smaller. The hole may be of any suitable depth. In an example embodiment, the hole passes through the entire shaft. In other example embodiments, the hole depth is less than the diameter of the shaft.

To understand how to best use the weight distribution system of the present invention, it is useful to examine the physics underlying the behavior of the inventive club. In the case of putter shaft movement, the user's arms and hands are locked into position and pivot from a pivot point at the shoulders. As discussed above this results in a pendulum where the arms and the shaft form the suspending element of the pendulum and where the head of the club serves as the bob of the pendulum. With this configuration in mind it is possible to make assumptions that facilitate modeling to appreciate the function of the weight control system. These assumptions include: 1) the shoulder is the pivot point (o) and the arms and hands operate as a lever connected to that point; 2) the swing from the pivot point (o) is of a constant angular velocity; and 3) the arms and hands have no mass. These assumptions allow one to isolate just the effect of the weights and their position on the shaft in terms of head speed. Further the assumptions can be justified because the position of the hands and arms relative to the club remains constant regardless of weight position and thus do not effect changes in head speed.

When the moving club strikes the ball momentum (energy) is transferred to the ball accelerating it to essentially the speed of the moving head. Therefore, it is assumed that head velocity and ball speed are essentially equivalent. To isolate the energy involved so as to understand the relationship between moveable weight position and head velocity one can consider the total kinetic energy or moment of inertia ($I_o$) of the system according to Formula 1 where "$m_s$" is the mass of the shaft; "$m_h$" is the mass of the head; and "$m_w$" is the mass of the moveable weight. Similarly, "$l_s$" is the distance from the pivot point o to the center of gravity of the shaft; "$l_h$" is the distance from the pivot point o to the center of gravity of the head; and "$l_w$" is the distance from the pivot point o to the center of gravity of the moveable weights.

$$I_o=(m_s l_s^2+m_h l_h^2+m_w l_w^2) \quad \text{Formula 1}$$

From Formula 1 one is able to derive Formula 2 which yields the head velocity $V_m$ which is assumed to be the initial ball velocity as well. The initial angular velocity (i.e., before striking the ball) is $\omega_i$ while the final angular velocity (i.e., after striking the ball) is $\omega_f$ and the mass of the ball is $m_b$.

$$V_m=\text{sqrt}[(m_s l_s^2+m_h l_h^2+m_w l_w^2)(\omega_1^2-\omega_f^2)/m_b] \quad \text{Formula 2}$$

The goal is to determine differences in force applied to the ball as the weight position changes. Therefore, in solving for $V_m$ one can simplify the calculation by assuming that the difference between the initial and final angular velocity is constant. It is also safe to assume that the difference in angular velocity before and after striking a ball is the same for both a weighted and unweighted shaft. For the purpose of the following simulations, $(\omega_i^2-\omega_f^2)$ was set to 1 rad./s. The mass of the ball (a constant) is included to allow a ready check on the magnitude of the velocity.

The impulse-momentum theorem (Formula 3) can be used to calculate the average force ($F_{av}$) applied to the ball. $V_b$, the initial velocity of the ball is approximately equal to $V_m$, the velocity of the head when it strikes the ball. The duration of contact between the head and the ball ($\Delta t$) is assumed to be 10 ms.

$$F_{av}=(m_b V_b/\Delta t) \quad \text{Formula 3}$$

Through using these formulas, it is possible to determine force parameters for a variety of different configurations of weight placement.

The percentage increase in force for a given added weight at a given shaft position is greater the shorter the shaft and the lighter the head. This is due to the fact that the added weight operates by changing the moment of inertia of the system and has its greatest effect when the original moment of inertia is smallest (i.e., the lightest head and the lightest shaft). The greater the distance between the pivot and the weight, the greater the effect on the change in force. According to Formula 3 the velocity of the ball is directly proportional to the average force so that as the force increases, the velocity of the ball increases. Because of the pendulum effect discussed above lowering the weight position without altering the take-back distance allows one to achieve the same ball velocity as would normally require a greater take-back distance. This reduction in take-back distance results in less push and pull. Thus, by reducing take-back distance, the present system is particularly useful for long putts which normally require so much pull back that pull or push results. Of course, the reduction in take-back can result in an improvement in short putts as well.

The method of using one example embodiment of the disclosed golf club is simple and involves the concept of "green speed" which is the speed and distance a ball travels on a given green. The general version of this measurement is "surface speed characteristics" which is the speed for any particular portion of a golf course. Physical laws dictate that the faster a ball is traveling when it enters a green, the farther it will travel on that green. However, some greens are "faster" than others meaning that a particular green offers less friction to a traveling ball than another green so that the ball decelerates more slowly and travels farther. A smooth and dry green that has been mowed short will be faster—offer less friction—than a bumpy and moist green that has been mowed to have longer grass. A simple device known as a Stimpmeter is used to accelerate a ball to a uniform and known speed before it rolls on to a green. The distance that the ball travels is then an expression of the green speed. For example, if the ball travels 14 ft (4.27 m), the green speed is 14 which is considered to be quite fast. If the ball rolls on 6 ft (1.83 m), the green speed is 6 which is relatively slow.

Using the formulae presented above and some testing, it is possible to derive a relationship between a given club swung with a given force at a fixed take-back distance and green speed achieved. It turns out that a considerable range of green speeds can be achieved by adjusting the weight positions. Table 3 shows a portion of such a relationship chart for an experimental club. The table shows the position that a given weight should be placed for a given green speed. Comparing the positions with the green speed one sees that for a "fast" green of 14 feet the smallest weight is placed in the least effective position—this is because for a fast green one wants the lowest increase in force. For a slow green of 6 ft speed a larger weight is placed in the most effective (the lowest) position. This gives a compensating boost to ball without significantly changing the take-back distance.

To utilize the present invention the player should first practice putts with the club without weights until the player can reliably produce putts of a repeatable distance and a consistent take-back distance. That is, the player learns to apply a repeatable acceleration at a fixed take-back distance. Next faced with an actual putt the player determines the green speed of the hole in question (the green speed is measured and available information at a high level professional level course—alternately the player could use a Stimpmeter to measure actual green speed). Then following the chart for the particular model of inventive club at hand, the player adjusts the weights to most closely match the known surface speed characteristics. The club then takes care of the required change in head speed without a significant change in take-back distance. It will be appreciated that without the inventive system, a player is faced with the daunting task of changing take-back distance and/or applied force in an attempt to overcome variations in green speed. A very skilled golfer may be equipped to simultaneously adjust these multiple factors to achieve the desired result, but this is beyond the ability of many ordinary golfers. With the inventive device the number of variables is reduced. All the player need do is learn to perform a stroke with a consistent force and a consistent take-back difference. By adjusting the weight system in the club to match the target green speed, the simple consistent stroke is transformed to match the actual green speed of the green at hand.

TABLE 3

Green Speed versus Weight and Weight Position.

| Green Speed | Position along shaft | Weight (oz) |
|---|---|---|
| 14 | Upper | 0.5 |
| 13 | Upper | 1.0 |
| 12 | Upper | 1.5 |
| 11 | Middle | 0.5 |
| 10 | Middle | 1.0 |
| 9 | Middle | 1.5 |
| 8 | Lower | 0.5 |
| 7 | Lower | 1.0 |
| 6 | Lower | 1.5 |

It will be appreciated that such a chart depends not only on the characteristics of the club and the precise take-back difference but the force/acceleration applied by the user. A goal of the present system is for the user to develop a consistent stroke (same take-back distance and same application of force/acceleration). This can be attained by repeated practice putts on a uniform green. The end result will be the ability to reliably produce a putt that goes a set distance (say six feet). Thereafter the weight management system (in conjunction with the appropriate chart for a given club) is used to attain that distance regardless of green speed and using the same consistent stroke. Without the weight management system a player must try to constantly adjust their stroke to account for changes in green speed. This has the tendency of rendering the player's stroke less and less consistent. With sufficient native ability and practice a player may eventually master the process of adjusting the stroke in accord with the green. The present approach accelerates the learning process by allowing the player to develop a consistent stroke while at the same time being able to respond to changes in green speed. It is noted that Table 3 can be modified depending on the weight of the plugs and locations of the plugs. Moreover, the table can be replaced with any suitable electronic look-up or other way of associating variations in the green speed with weight and location of the weights on the shaft to produce a repeatable distance put using a consistent stroke on different speed greens. Thus, any suitable relationship between weight and location on the one hand and green speeds on the other may be represented by the table or other system for making the association useable on a golf course.

Surprisingly, in actual practice the weight system is effective over a larger range of green speeds than might otherwise be expected. Speed and force are directly proportional (Formula 3). However, the changes in green speed in Table 3 are in the range of 7% or more for each step (change in speed of one foot). The answer is that ball speed and green speed are not the same thing. Green speed is a measurement of how far a ball traveling at a set initial velocity will travel on a particular green. In altering the ball speed so that the ball will go the same distance on greens of different speeds the magnitude of change in ball speed is not the same as the magnitude of change in green speed. That is, if a green speed is 10 ft and at a given initial velocity a ball travels 5 ft, and then that same initial velocity is applied to a green with a speed of 9 ft, the ball does not travel precisely one foot less—that is 4 ft.

This same principle can be applied to other clubs like drivers where club velocity and ball speed are related to the distance a ball will travel (generally through the air) although ball velocity when it strikes the ground will interact with local surface speed characteristics to control how far the ball will roll. With a driver, desired distance is generally the key factor that dictates adjustment of moment of inertia. The overall method is the same but the adjustment tables generally relate desired distance to weight position. With a putter as the green speed decreases moment of inertia is increased to keep the stroke and take-back distance consistent. With a driver, using a given club, distance can be increased while maintaining a consistent stroke by increasing the moment of inertia.

The most important variables in a stroke are stroke speed and head velocity. This translates to ball travel distance. The correct head velocity and corresponding optimum ball speed equates to the amount of force that must be applied.

The property of physics that indicates the relative difference in how easy or difficult it is to set any object, in this case a golf ball, in rotational motion about its axis, is called: Moment of Inertia, or MOI. The higher the MOI of the ball, the higher the force that will need to be applied to set the ball in a motion. Conversely, the lower the MOI, the less force needed to make the golf ball rotate.

This Precise Weighting Technology allows the Moment of Inertia (MOI) of the club to be predictably adjusted by either moving the weight closer to the head whereby increasing MOI or decreasing MOI closer to the grip. An increase in force translates to an increase in the MOI which is proportional to club velocity. Hence the ball will travel a greater distance, depending on the characteristics of the playing surface, expressed in terms of "green speed" when putting as measured by a Stimpmeter or similar measurements on other parts of the course. MOI can be increased as green speed decreases, delivering a shot that travels as far as the same stroke would deliver on a fast surface.

This technology reduces the margin of error a golfer is faced with on every putt. On every putt, a golfer must decide how far to bring the putter head back to achieve the desired amount of force necessary to achieve the proper putt distance. Adjusting the weights, amount and position, along the shaft allows a golfer to increase or decrease putter head speed. Move the weight down the shaft towards the putter head and increase club head speed without the need to increase club head take-back distance. With the ability to increase putter head speed by using a series of weights, a golfer can now use less putter head take-back distance to achieve the same putt distance. Less take back distance reduces the critical area of error in which pushing and pulling occurs; this equates to less pushed and pulled putts.

At the address of the ball, if the club head is not perpendicular, the ball will be driven in the wrong direction and will not attain optimum speed. If the margin of error is reduced by having a shorter take back distance in our putting stroke, there is less chance of a pushed or pulled putt. Pulling and pushing putts are the two main reasons for missed putts. A push occurs when the heel of the putter head is ahead of the of the putter toe at impact. The golf ball will travel to the right of the intended target line. A pull is the opposite. In a pull, the toe of the putter head is ahead of the heel at impact. The ball will travel to the left of the intended target line. Less take-back distance reduces the margin for error in the most critical area where the twisting and turning of the club head occurs to cause pushing and pulling.

Muscle memory is a form of what is known as "procedural memory" which guides the specific motor task performed into memory through repetition. When a movement is repeated over time, a long-term muscle memory is created for that particular task. This process creates maximum efficiency by joining the motor and memory systems together. Muscle memory is found in many everyday activities that become automatic and improve with practice, such as: riding a bike, typing, playing a musical instrument or a video game, or in puffing.

By adjusting of the weight and position of weights along the golf club shaft, a consistent muscle-memory Range of Movement (ROM) is maintained, eliminating green speed error. On any course in the world, this means the golfer matches their preferred weight and position, aligned to the speed of that particular course, using the same exact muscle-memory ROM each and every time.

Weights can also be applied towards the grip end of the golf club called "counterbalancing" or "back weighting". The extra mass that is placed at the grip end of the club is to counter a heavier head. Counterbalancing is most effective and noticed in putting, although the benefits of counterbalancing can be felt in all clubs. This weighting improvement boosts the club's overall (MOD, so that the club swings and feels more stable throughout the stroke.

Counterbalancing is designed to enhance and magnify the vibration response of the golf club in your hands. The vibration information is the sensation that a player kinesthetically feels with their hands at impact. This valuable information will help the player understand where on the golf ball impacts the face of the club. This vibration response is the definition of feel.

What is claimed is:

1. A weighted golf club shaft comprising a central shaft, the central shaft comprising a plurality of holes configured to receive a plurality of plugs, each plug configured to be removably inserted into a hole in the plurality of holes, wherein at least one plug is removably inserted into a hole in the plurality of holes, the at least one plug only fastening itself to the central shaft, wherein at least one of the at least one plug is a weighted metal plug, wherein the plurality of holes are located on a first plane of the central shaft and on a second plane of the central shaft, and wherein the second plane is offset by an angle from the first plane.

2. The weighted golf club shaft of claim 1, wherein the weighted plug weighs greater than or equal to approximately 14 grams.

3. The weighted golf club shaft of claim 1, wherein the weighted plug is comprised of a high density material.

4. The weighted golf club shaft of claim 1, wherein more than one weighted plugs are removably inserted into the plurality of holes.

5. The weighted golf club shaft of claim 1, wherein the plurality of holes exist in a plurality of rows along the central shaft.

6. The weighted golf club shaft of claim 1, wherein the plurality of plugs comprises weighted and non-weighted plugs.

7. The weighted golf club shaft of claim 1, wherein each of the plurality of holes is filled with a plug selected from a group consisting of: the weighted plug and a non-weighted plug.

8. The weighted golf club shaft of claim 1, wherein the weighted plug comprises tungsten.

9. A weighted golf club assembly, comprising:

a central shaft comprising a plurality of holes;

a weight management system consisting of a plurality of weighted plugs and a plurality of non-weighted plugs, each weighted plug configured to be removably inserted into a hole in the plurality of holes, each non-weighted plug configured to be removably inserted into a hole in the plurality of holes;

wherein at least one weighted plug is removably inserted, wherein each weighted plug comprises a high density material, wherein the plurality of holes are located on a first plane of the central shaft and on a second plane of the central shaft, and wherein the second plane is offset by an angle from the first plane.

10. The weighted golf club assembly of claim 9, wherein the high density material comprises tungsten.

* * * * *